US005894752A

United States Patent [19]

Yano et al.

[11] Patent Number: 5,894,752

[45] Date of Patent: Apr. 20, 1999

[54] METHOD AND SYSTEM FOR WARM OR HOT HIGH-VELOCITY DIE FORGING

[75] Inventors: Masakazu Yano; Katsuhiko Osaki; Tadatsugu Yoshida, all of Himeji; Yoshio Kasahara, Okayama, all of Japan

[73] Assignee: Sanyo Special Steel Co., Ltd., Hyogo-ken, Japan

[21] Appl. No.: 08/931,761

[22] Filed: Sep. 16, 1997

[30] Foreign Application Priority Data

Sep. 19, 1996 [JP] Japan ..... 8-271728

[51] Int. Cl.[6] ..... B21J 13/02

[52] U.S. Cl. ..... 72/355.6; 72/355.2; 72/359

[58] Field of Search ..... 72/353.2, 354.6, 72/354.8, 355.2, 355.6, 358, 359

[56] References Cited

U.S. PATENT DOCUMENTS

| | | | |
|---|---|---|---|
| 2,675,125 | 4/1954 | Genders . | |
| 3,631,706 | 1/1972 | Archer et al. | 72/355.6 |
| 4,653,310 | 3/1987 | Urata et al. | 72/355.6 |

FOREIGN PATENT DOCUMENTS

| | | | |
|---|---|---|---|
| 0747144 A1 | 12/1996 | European Pat. Off. . | |
| 1317638 | 12/1989 | Japan . | |
| 1731394 | 5/1992 | Russian Federation | 72/355.6 |

*Primary Examiner*—Lowell A. Larson

*Attorney, Agent, or Firm*—Birch, Stewart, Kolasch & Birch, LLP

[57] ABSTRACT

An axially symmetric ring work piece is formed by a warm or hot, forward and backward extruding, die forging system. In this system, a die having a rearwardly projecting portion, which projects in the opposite direction to a pressing direction, a heated work piece, and a punch having a forwardly projecting portion, are arranged, in that order, in a container. A withdrawal die is arranged between the container, and the heated work piece, the die and the punch. The die is fixed so that a die velocity $V_D$ is 0, and the punch is moved toward the die while a punch velocity $V_P$ is set to be twice as large as a withdrawal die velocity $V_{WD}$ and the strokes of slide of the withdrawal die are not less than one-half of a forward-extruded foot length of a product. Thus, the forward and backward simultaneous extrusion can be substantially performed in a single-action type, short-stroke, die forging system. In addition, it is possible to effectively and accurately form a ring part, which has good metal flow and no defects, and which has a stable quality, at higher than 80 strokes per minute.

3 Claims, 7 Drawing Sheets

METHOD AND SYSTEM FOR WARM OR HOT HIGH-VELOCITY DIE FORGING

BACKGROUND OF THE INVENTION

1. Field of the Invention

The present invention relates generally to a system for performing a warm or hot high-velocity die forging and a method for performing the same. More specifically, the invention relates to the manufacturing of a ring part by a warm or hot die forging, particularly by a forward and backward extrusion, high-velocity die forging.

2. Description of the Prior Art

In recent years, the accuracy of dimensions and shape of die forged parts has been required strictly year by year in order to decrease the number of steps by near net shape forming. On the other hand, the manufacturers have made various attempts to increase the manufacturing efficiency to reduce the costs to make profits.

In order to manufacture various ring parts, a ring part 13 shown in FIG. 4(*b*) is generally obtained by ring rolling of a ring material 18 shown in FIG. 4(*a*) after the hot forging.

Referring to the drawings, conventional methods for manufacturing a ring part will be described below.

A method shown in FIGS. 5(*a*) through 5(*d*) comprises the steps of: open-up setting a sheared work piece 7 as a first step (FIG. 5(*a*)); forming a cup-shaped blank by the backward extrusion pressing as a second step (FIG. 5(*b*)); punching a bottom portion as a dummy portion 10 (which will be hereinafter referred to as a "punched scrap portion") as a third step (FIG. 5(*c*)); and forming an annular raised portion raised from the circumferentially extending central portion of the inner surface of the work piece by ironing as a fourth step (FIG. 5*d*)) (this method will be hereinafter referred to as "method A").

Another method shown in FIGS. 6(*a*) through 6(*d*) comprises the steps of: open-up setting a work piece 7 as a first step (FIG. 6(*a*)); forming a cup-shaped blank having a step 11 by the backward extrusion pressing as a second step (FIG. 6(*b*)); punching a bottom portion serving as a punched scrap portion as a third step (FIG. 6(*c*)); and forming a ring part by the ring rolling by means of a ring rolling machine shown in FIG. 9 as a fourth step (FIG. 6(*d*)) (this method will be hereinafter referred to as "method B").

In the case of method A, there is a disadvantage in that, since the central portion of the product is not restricted by the die, ununiform excess thickness may occur in the central portion of the product during the ironing in accordance with the lubrication in the die or the temperature during the forming. Therefore, even if ring rolling is performed, it is difficult to work a ring part as an object of the present invention. On the other hand, in the case of method B, there is a disadvantage in that a ring height 12 may be disengaged from a diesinking portion 19, i.e., a groove portion, of a forming roll during ring rolling to cause defective forming, and there is also a disadvantage in that cracks or flashes may be produced on the line of intersection of the raised inner-surface portion. And the other inner-surface portion since the outside rotating speed is different at the initial stage of forming. Therefore, the aforementioned method B can not be used to work a ring part as an object of the present invention.

In order to eliminate the aforementioned disadvantages in methods A and B, the inventors have studied a method for forming a ring part by ring rolling (which will be hereinafter referred to as "method C"), using the computer aided engineering (CAE) analysis and the plasticine simulation. As shown in FIGS. 7(*a*) through 7(*d*), the method C comprises the steps of: open-up setting a work piece 7 as a first step (FIG. 7(*a*)); preforming a cup-shaped blank by the forward extrusion pressing as a second step (FIG. 7(*b*)); performed the backward extrusion pressing as a third step (FIG. 7(*c*)); and punching a punched scrap portion 10 to form a ring part by ring rolling as a fourth step (FIG. 7(*d*)). In a case where a ring part is forged by the method C, the stroke of the used forging system may be shortened, so that the ring part can be sufficiently formed by means of a high-velocity die forging system having slide strokes per minute of not less than 80 per minute. However, as shown in FIG. 12, the turbulence of metal flow may be produced near the line of intersection of the outer wall portion with the bottom plate portion, or burrs may be produced on the peripheral portion. Since these burrs can not corrected by ring rolling as a secondary processing, it is difficult to stably provide good products.

In order to improve the aforementioned method C, the inventors have studied a method for forming a ring part by the CAE analysis, the plasticine simulation and ring rolling (which will be hereinafter referred to as "method D"). As shown in FIGS. 8(*a*) through 8(*c*), the method D comprises the steps of: open-up setting a work piece 7 as a first step (FIG. 8(*a*)); performed the forward and backward simultaneous extrusion pressing (the double-action pressing) as a second step (FIG. 8(*b*)); and punching a punched scrap portion 10 to form a ring part by ring rolling as a third step (FIG. 8(*c*)).

It was found that, in the case of the method D, the forging load can be reduced by 20% in comparison with the aforementioned method C, and it is possible to obtain a smooth metal flow and a sufficiently good quality. However, in order to form a product at higher slide strokes per minute than 80 per minute, a single-action type, short-stroke, die forging system (a horizontal former) must be used. Even if such a system is used, it is not possible to obtain a sufficient filling since the stroke is short, so that it is not possible to form a product by the double action pressing. However, a double-action type, high-velocity, die forging system has not been widely spread. In order to newly provide such a system, infinite costs are required for initial investment, so that such a system can not actually adopted. In addition, even if a long-stroke die forging system is remodeled into a double-action type system, the forging velocity is limited to decrease the manufacturing efficiency, so that the costs of the product are increased. That is, it has been conventionally difficult to obtain a ring blank of a stable quality, which is an object of the present invention.

As mentioned above, in order to form a ring part at higher slide strokes per minute than 80 per minute, a single-action type, short-stroke, die forging system (a horizontal former) must be used. Even if such a system is used, it is not possible to obtain a sufficient filling since the stroke is short, so that it is not possible to form a product by the double action pressing. In addition, a double-action type, high-velocity, die forging system has not been widely diffused. In order to newly provide such a system, costs required for initial investment are increased, so that such a system can not actually adopted.

SUMMARY OF THE INVENTION

It is therefore an object of the present invention to eliminate the aforementioned problems and to provide a system for manufacturing a ring part, which can perform a forward and backward substantially-simultaneous pressing although a single-action type, short-stroke, die forging system is used, which can provide a good metal flow and no defect, and which can effectively and accurately manufacture a ring part of a stable quality, and a method thereof.

In order to accomplish the aforementioned and other objects, according to one aspect of the present invention, there is provided a warm or hot, forward and backward extrusion, high-velocity die forging method for forming an axially symmetric ring work piece, which comprises the steps of: arranging a heated work piece, a punch having a projecting portion facing the work piece, and a die having a projecting portion facing the work piece, in a container in the order of the die, the heated work piece and the punch; arranging a withdrawal die between the container, and the die, the heated work piece and the punch which are arranged in the container; and pressing the heated work piece into a space between the projecting portions of the punch and the die and the withdrawal die, to form an axially symmetric ring work piece, wherein the heated work piece is pressed in a punch pressing direction, in which the punch is moved toward the die, while the die is fixed so that a die velocity VD is 0 and while a punch velocity VP is set to be twice as large as a withdrawal die velocity VWD and a stroke of slide of the withdrawal die is set to be equal to or longer than a half of a forward-extruded foot length of a product.

The container, and the die, the heated work piece and the punch, which are arranged in the container, may be arranged in horizontal directions, and the punch pressing direction may be a horizontal direction.

According to another aspect of the present invention, there is provided a method for forming a ring product having an annular projecting portion, which projects toward an axis of the ring product from a circumferentially extending central portion of an inner surface of the ring product. This method comprises the steps of: punching a punched scrap portion from a circumferentially extending central portion of a ring work piece formed by a warm or hot, forward and backward simultaneous extrusion, high-velocity die forging method; and ring rolling the ring work piece.

According to further aspect of the present invention, there is provided a warm or hot, forward and backward simultaneous extrusion, high-velocity die forging system, which comprises: a container 1; a die 2 having a projecting portion 3 and arranged in the container 1, the die 2 being associated with the container 1 to serve as a fixed die; a punch 4 having a projecting portion 5 and arranged in the container 1 so that the projecting portion 5 of the punch 4 faces the projecting portion 3 of the die 2 via a work piece 7 for pressing the work piece 7 by moving the punch 4 toward the die 2; and a withdrawal die arranged between the container 1, and the die 2, the work piece 7 and the punch 4, which are arranged in the container 1, wherein a withdrawal die velocity is set to be a half of a punch velocity, and a stroke of slide of the withdrawal die is set to be equal to or higher than a half of a forward-extruded foot length 25 (FIG. 4(*a*)) of a product.

The container, the die, the work piece and the punch may be arranged in horizontal directions, and the moving direction of the punch may be a horizontal direction.

A method for manufacturing a ring part by hot die forging using a withdrawal die, according to the present invention, will be described below.

According to the present invention, as shown in FIG. 2, the slide stroke velocity and the movable length of a withdrawal die 6 in the moving direction shown by arrows 9 may be regulated by supporting the front or rear end (not shown) of the withdrawal die 6 on cylinders 20. Alternatively, as shown in FIG. 3, the slide stroke velocity and the movable length of a simplified withdrawal die 6 in the moving direction shown by arrows 9 may be regulated by the reaction force of springs 21.

According to the present invention, die forging is performed, at higher slide strokes per minute than 80 per minute, by means of a die 2 having a projecting portion 3, a punch 4 having a projecting portion 5, and a withdrawal or simplified withdrawal die 6 which is movable in pressing directions. Assuming that the working velocities of the punch 4, the withdrawal die 6 and the die 2 are $V_P$, $V_{WD}$ and $V_D$, respectively, and that the moving direction 8 of the punch 4 is positive, an ideal ratio of working velocities of the respective tools can be expressed by the following formula (1):

$$V_P:V_{WD}:V_D=2:1:0 \quad (1)$$

When this is studied as a relative velocity with respect to the working velocity $V_D$ of the die 2, the ratio of working velocities can be expressed by the following formula (2):

$$V_P:V_{WD}:V_D=1:0:-1 \quad (2)$$

The formula (2) shows that it is substantially the same as the aforementioned method D serving as the double-action pressing method.

Therefore, the double-action pressing method can be compactly performed using the withdrawal die, so that the aforementioned method D can be applied to a short-stroke, high-velocity, die forging system.

Moreover, the inventors have studied the relationship between the ratio of the stroke of slide of the withdrawal die to the forward-extruded foot length 25 of a product, and the filling rate. The results thereof are shown in FIG. 10.

The filling rate was estimated by the length of a foot when operated, with respect to a predetermined dimension (an extruded foot length). It can be seen from the results shown in FIG. 10 that the critical ratio of the stroke of slide of the die and the extruded length of the product is 1:2, i.e., 0.5. Furthermore, when the ratio of the stroke of slide to the forward-extruded foot length was 0.5, the actual stroke of slide of the die and the actual extruded foot length were 7.9 mm and 14.7 mm, respectively.

According to the present invention, the punch 4 is pressed toward the die 2 while the stroke of slide of the withdrawal die is set to be not less than a half of the forward-extruded foot length of the product, so that the metal flow 22 formed by die forging may be good and material can be distributed in the whole forging die as shown in FIG. 11. On the other hand, when a ring material is manufactured by means of a die forging system wherein the stroke of slide of the withdrawal die is set to be one third as large as the forward-extruded foot length of the product, it was observed that underfill portions 24 occur on both ends of the work piece as shown in FIG. 13.

According to the hot die forging method of the present invention, it is possible to prevent peripheral burrs from being produced so as to eliminate the disadvantage in the conventional method C, and it is also possible to prevent the ring height from being disengaged from the roll diesinking portion (groove portion) 19 to prevent the defective forming in the ring rolling process so as to eliminate that the disadvantage in the conventional method B. In addition, if the ring rolling is performed after the hot die forging of the present invention is carried out, it is possible to prevent the production of cracks and flashes, which are produced on the line of intersection of the projecting inner-surface portion with the other inner-surface portion due to the difference in rotating speed of the blank at the initial stage of forming. Thus, it is possible to manufacture a ring part of a good quality, which has no burrs and defectives on the periphery, i.e., a ring part having a circumferential projecting portion which projects from the inner surface toward the axis of the ring part.

BRIEF DESCRIPTION OF THE DRAWINGS

The present invention will be understood more fully from the detailed description given herebelow and from the accompanying drawings of the preferred embodiments of the invention. However, the drawings are not intended to imply limitation of the invention to a specific embodiment, but are for explanation and understanding only.

In the drawings:

FIG. 4(*b*) is a sectional view of a ring part after ring rolling;

DESCRIPTION OF THE PREFERRED EMBODIMENTS

Referring now to the accompanying drawings, the preferred embodiments of the present invention will be described below.

Figure 1:
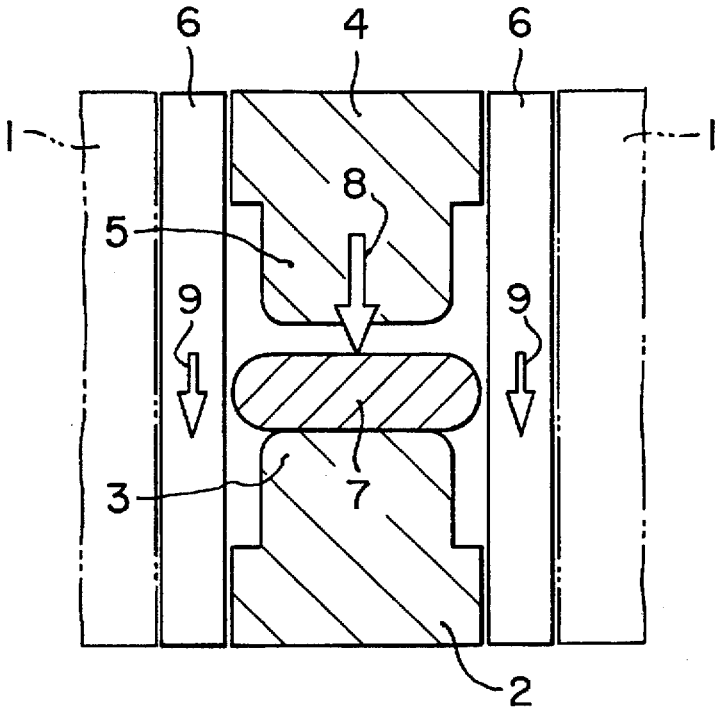
FIG. 1 is a schematic view of a warm or hot die forging system using withdrawal or simplified withdrawal dies which are movable in pressing directions.
Figure 2:
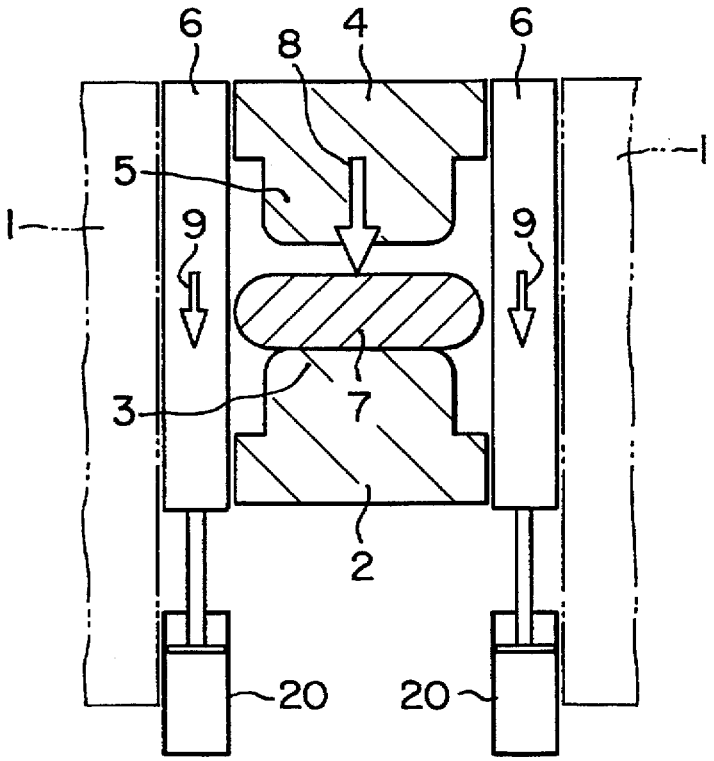
FIG. 2 is a schematic view of a withdrawal type warm or hot die forging system.
Figure 3:
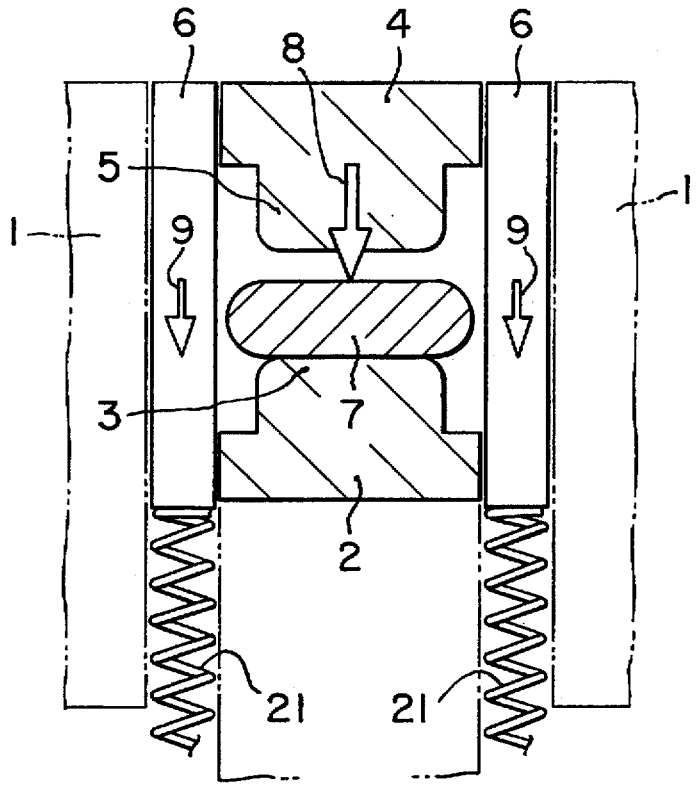
FIG. 3 is a schematic view of a simplified withdrawal type warm or hot die forging system.

FIGS. 1 through 3 show a high-velocity die forging system having a withdrawal die according to the present invention. In these drawings, reference number 1 denotes a container. In the container 1, a die 2 having a projecting portion 3 is arranged so that the projecting portion 3 projects in the opposite direction to the extruding direction. A heated work piece 7 is set so as to contact the projecting portion 3 of the die 2. Then, a punch 4 having a projecting portion 5 is arranged so that the projecting portion 5 faces the work piece 7. A withdrawal die 6 is arranged between the container 1, and the work piece 7, the die 2 and the punch 4.

In the case of the die forging system shown in FIG. 2, the front end portions of the withdrawal die 6 are supported on cylinders 20 so as to regulate the strokes per minute and the stroke of slide of the withdrawal die 6.

The die forging system shown in FIG. 3 uses a simplified withdrawal die 6 wherein stroke velocity and the stroke of slide thereof are regulated by the reaction force of the springs 21 in place of the cylinders 2 shown in FIG. 2.

Figure 4A:
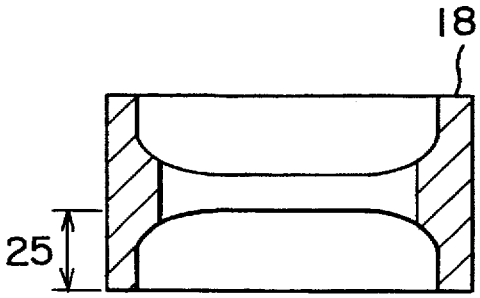
FIG. 4(*a*) is a sectional view of a ring work piece after warm or hot forging.
Figure 4B:
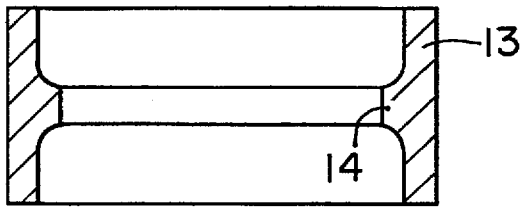
Figure 5A:
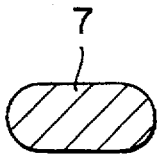
FIGS. 5(*a*) through 5(*d*) are manufacturing process drawings of a ring part by conventional method A.
Figure 5B:
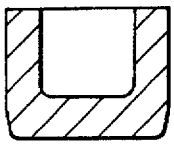
Figure 5C:
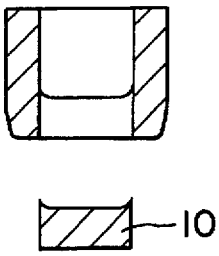
Figure 5D:
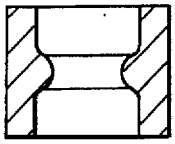
Figure 6A:
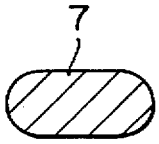
FIGS. 6(*a*) through 6(*d*) are manufacturing process drawings of a ring part by conventional method B.
Figure 6B:
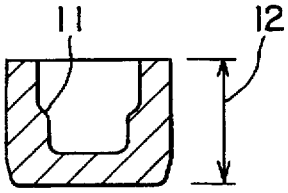
Figure 6C:
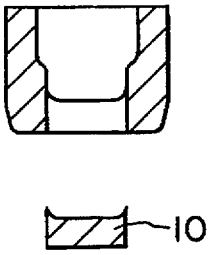
Figure 6D:
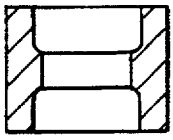
Figure 7A:
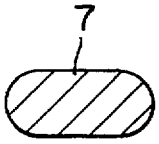
FIGS. 7(*a*) through 7(*d*) are manufacturing process drawings of a ring part by conventional method C.
Figure 7B:
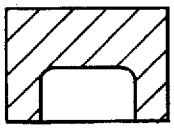
Figure 7C:
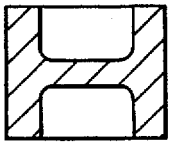
Figure 7D:
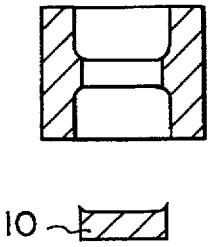
Figure 8A:
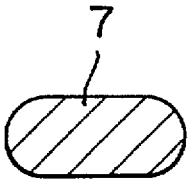
FIGS. 8(*a*) through 8(*c*) are manufacturing process drawings of a ring part by conventional method D.
Figure 8B:
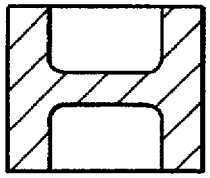
Figure 8C:
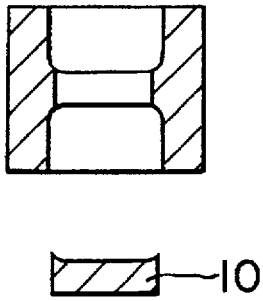

In these die forging system, the die 2 is fixed so that the die velocity $V_D$ is 0. The punch velocity $V_P$ in the punch moving direction 8 is set to be twice as large as the withdrawal die velocity $V_{WD}$ in the withdrawal die moving direction. The cylinders 20 or the springs 21 are set so that the stroke of slide of the withdrawal die 6 is not less than a half of a forward-extruded foot length 25 of a ring raw material 18. After the die forging system is thus set, the punch 4 is pushed toward the die 2 to perform the warm or hot die forging, so that a ring work piece 18 is formed by the forward and backward simultaneous extrusion. As shown in FIG. 4(*a*), the ring work piece 18 has an annular projecting portion 14 which extends on the inner surface of the ring work piece 18 along the central portion thereof extending in circumferential directions and which projects toward the central axis from the inner surface of the ring work piece 18.

Figure 9A:
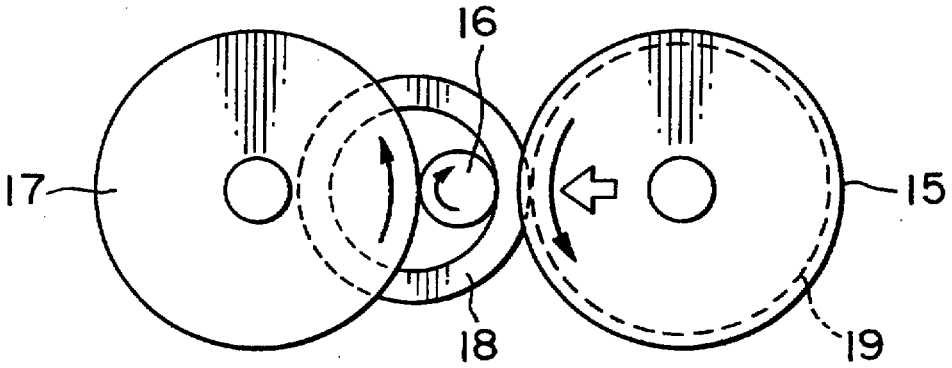
FIG. 9(*a*) and 9(*b*) are explanatory drawings of a ring rolling of a ring work piece.
Figure 9B:
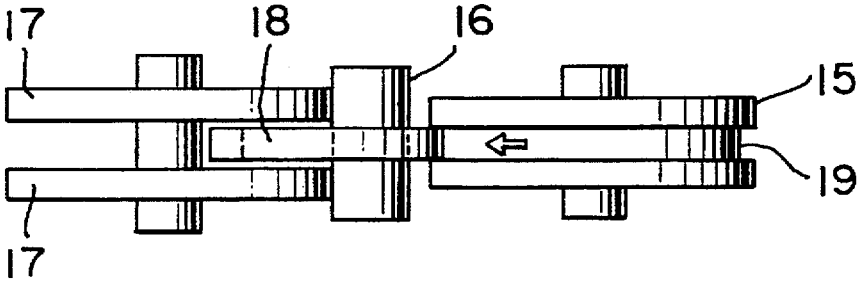
Figure 10:
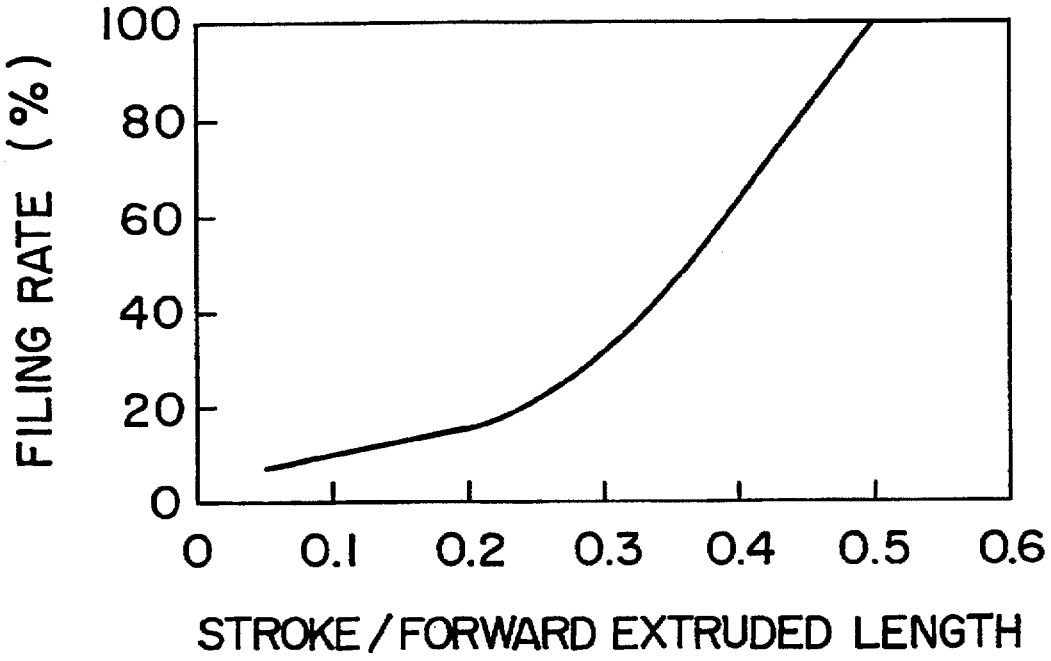
FIG. 10 is a graph showing the relationship between the stroke/forward extruded length and the filing rate.

Then, a punched scrap portion 10 is punched from the central portion of the formed ring work piece 18, and thereafter, a ring product 13 shown in FIG. 4(*b*) is finished by the ring rolling by means of a ring rolling forming machine shown in FIGS. 9(*a*) and 9(*b*), wherein the ring work piece 18 is arranged between a groove portion of a mandrel 16 supported on a receiving 17 and a diesinking portion 19 of a main roll 15.

EXAMPLE

The hot die forging of a bearing steel ring part was performed by the method of the present invention and the conventional method C, and the dimensional accuracy thereof was compared with each other. The work piece was a bearing steel, and the dimension of the work piece was ϕ42 mm. Such a steel product was sheared into cylindrical blanks having a length of 40 mm. Thereafter, the hot die forging of a ring part was performed using a simplified withdrawal die according to the present invention. The forging temperature was 1150° C. The used forging system was a horizontal hot former, and the slide strokes per minute were 80 to 120 strokes/minute.

Figure 11:
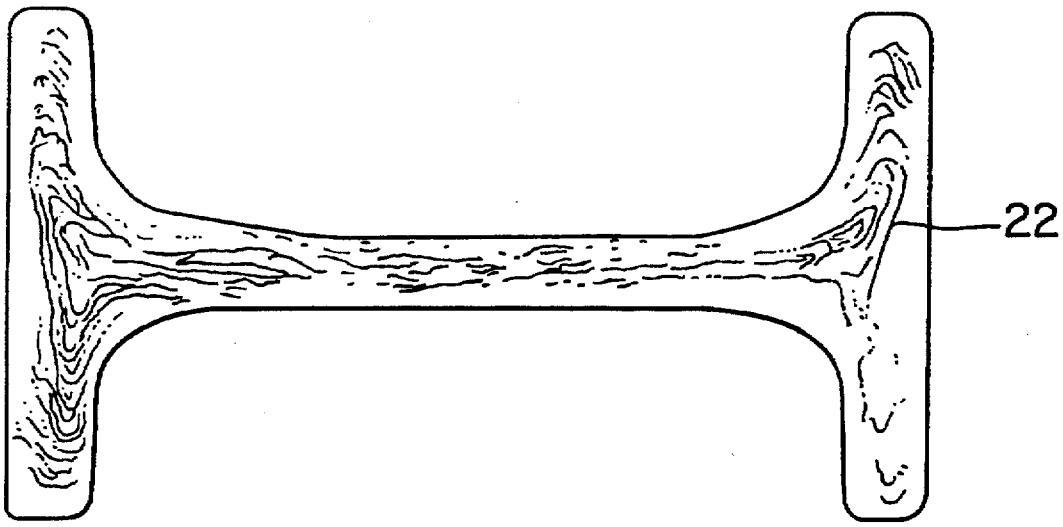
FIG. 11 is a schematic view illustrating a metal flow on a longitudinal section containing the central axis of a ring part before the step of punching a punched scrap portion after being produced by a withdrawal die according to the present invention.
Figure 12:
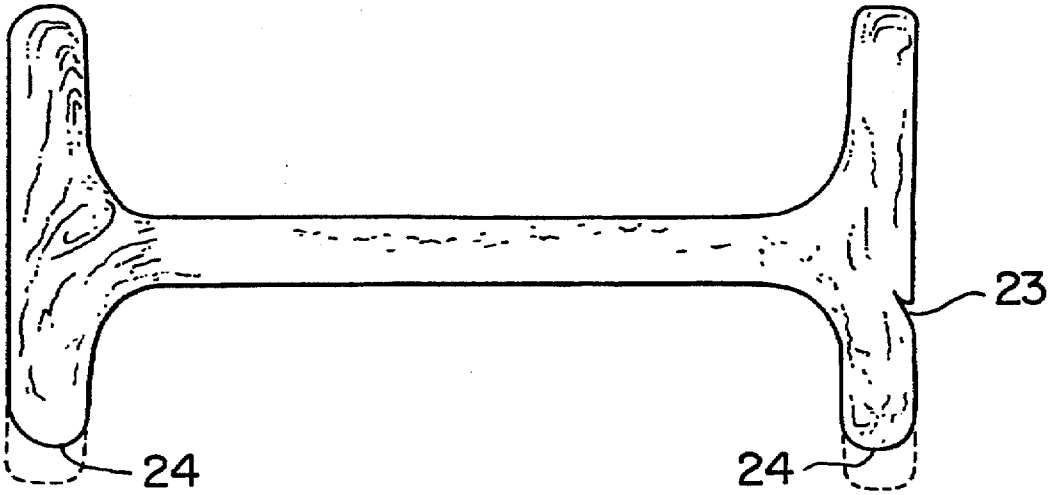
FIG. 12 is a schematic view illustrating a metal flow on a longitudinal section containing the central axis of a ring part before the step of punching a punched scrap portion after being produced by the conventional method C.
Figure 13:
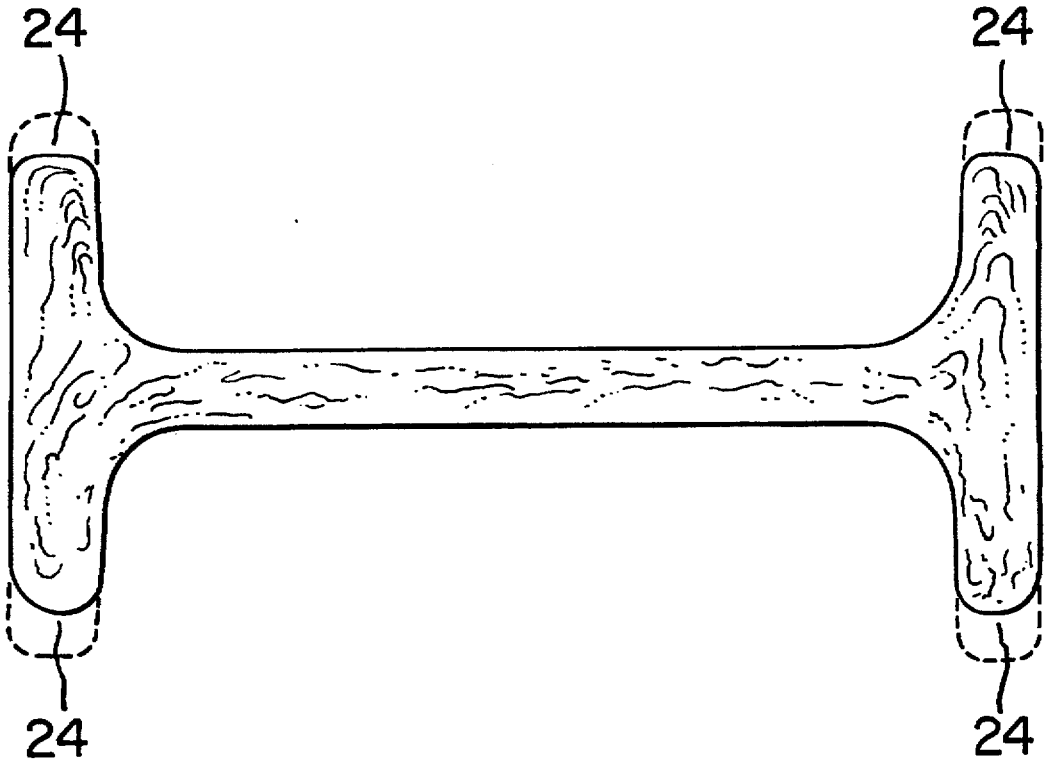
FIG. 13 is a schematic view illustrating a metal flow on a longitudinal section containing the central axis of a ring part produced using a die forging system wherein the stroke of slide of a withdrawal die is set to be one third as large as the forward-extruded foot length, which shows a comparative example.

FIG. 11 is a schematic view of a metal flow on a longitudinal section containing the central axis of the ring work piece 18, which was manufactured by the method according to the present invention, before the punched scrap portion 10 was punched. FIG. 12 is a schematic view of a metal flow on a longitudinal section containing the central axis of the ring work piece 18, which was manufactured by the conventional method C, before the punched scrap portion 10 was punched before the ring rolling.

Comparing FIG. 11 of the present invention with FIG. 12 showing the method C, it was found that the ring work piece manufactured by the method according to the present invention has a smooth metal flow. It was also found that the tip portions of the ring work piece manufactured by the method according to the present invention have a minimum underfill and burr, so that the work piece has a good dimensional accuracy and no burr on the peripheral portion thereof. After working, the ring rolling of the work piece was performed, and the formed product was tested. As a result, the dimensional accuracy of the height and outside diameter was not greater than 0.2 mm, and the dimensional accuracy of the inside diameter did not exceed ±0.2 mm, so that it was validated that the product has a sufficiently good accuracy and a superior quality.

In the aforementioned preferred embodiment, while the simplified withdrawal die regulated by the springs 21 has been used, the withdrawal die regulated by the cylinders 20 shown in FIG. 2 may be used to obtain the same advantages. In the case of the ring work piece manufactured by the method C shown in FIG. 12, the underfill portion 24 and the burr 23 were formed due to insufficient metal flow. The product formed by ring rolling after hot die forging was tested. As a result, it was validated that the product has sufficiently good quality.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A warm or hot, forward and backward simultaneous extruding, high-velocity die forging method for forming an axially symmetric ring work piece, which comprises the steps of:

arranging a heated work piece, a punch having a projecting portion facing the work piece, and a die having a projecting portion facing the work piece, in a container in the order of the die, the heated work piece and the punch;

arranging a withdrawal die between the container, and the die, the heated work piece and the punch which are arranged in the container, wherein the container, and the die, the heated work piece and the punch, which are arranged in the container, are arranged in horizontal directions, and the punch pressing direction is a horizontal direction; and pressing the heated work piece into a space between the projecting portions of the punch and the die and the withdrawal die, to form an axially symmetric ring work piece;

wherein the heated work piece is pressed in a punch pressing direction, in which the punch is moved toward the die, while the die is fixed so that a die velocity $V_D$ is 0 and while a punch velocity $V_P$ is set to be twice as large as a withdrawal die velocity $V_{WD}$ and a stroke of slide of the withdrawal die is set to be equal to or longer than a half of a forward-extruded foot length of a product.

2. A method for forming a ring product having an annular projecting portion, which projects toward an axis of the ring product from a circumferentially extending central portion of an inner surface of the ring product, the method comprising the steps of:

punching a punched scrap portion from a circumferentially extending central portion of a ring work piece formed by a warm or hot, forward and backward simultaneous extruding, high-velocity die forging method as set forth claim 1; and ring rolling the ring work piece.

3. A warm or hot, forward and backward simultaneous extrusion, high-velocity die forging system, comprising:

a container;

a die having a projecting portion and arranged in the container, said die being associated with the container to serve as a fixed die;

a punch having a projecting portion and arranged in the container so that the projecting portion of the punch faces the projecting portion of the die via a work piece for pressing the work piece by moving the punch toward the die; and a withdrawal die arranged between the container, and the die, the work piece and the punch, which are arranged in the container;

wherein a withdrawal die velocity is set to be a half of a punch velocity, and a stroke of slide of the withdrawal die is set to be equal to or longer than a half of a forward-extruded foot length of a product, and wherein the container, and the die, the work piece and the punch, which are arranged in the container, are arranged in horizontal directions, and the punch pressing direction is a horizontal direction.

* * * * *